United States Patent [19]

Magnat

[11] 4,166,320

[45] Sep. 4, 1979

[54] APPARATUS FOR TRACING ELLIPSES

[76] Inventor: Pierre Magnat, 1 Allee des Petits Pres, 78130 Elancourt, Yvelines, France

[21] Appl. No.: 880,001

[22] Filed: Feb. 21, 1978

[30] Foreign Application Priority Data

Feb. 21, 1977 [FR] France ..... 77 05493

[51] Int. Cl.[2] ..... B43L 11/04
[52] U.S. Cl. ..... 33/31
[58] Field of Search ..... 33/31, 30 R

[56] References Cited

U.S. PATENT DOCUMENTS

| | | | |
|---|---|---|---|
| 422,252 | 2/1890 | Rawson | 33/31 |
| 2,646,623 | 7/1953 | Coats | 33/31 |
| 2,879,596 | 3/1959 | Kroenlein | 33/31 |
| 2,996,804 | 8/1961 | Hancox | 33/31 |

FOREIGN PATENT DOCUMENTS

| | | | |
|---|---|---|---|
| 80177 | 3/1895 | Fed. Rep. of Germany | 33/31 |
| 1495005 | 8/1967 | France | 33/31 |
| 23062 | of 1910 | United Kingdom | 33/31 |
| 662997 | 12/1951 | United Kingdom | 33/31 |

*Primary Examiner*—Harry N. Haroian
*Attorney, Agent, or Firm*—Haseltine, Lake & Waters

[57] ABSTRACT

Apparatus for tracing elliptical curves comprising a T-shaped support member having perpendicular longitudinal and transverse branches and formed as a one piece injection molded body. The T-shaped member carries a point support on the longitudinal branch for piercing a tracing surface on which a curve is to be reproduced. Two sliders are respectively supported in recesses in the branches and the sliders are coupled together for correlated movement in the branches. A marking element is supported by the coupling for tracing a curve on the tracing surface in accordance with the movement of the sliders.

14 Claims, 10 Drawing Figures

F
E

21⁴
23
21
20¹
12
21³
14³
14⁵
21⁷
14⁶
20
18¹
18²
15¹
17
18
13
16³
16¹
16²

14
12
20
15²
15³
20³
15¹

14³
20¹
20
VII
21
13
VII
22²
14⁶
19
14
22¹
12
15²
15¹
IV
20³
IV
14¹
24
25¹
25

14⁸
14
12
16¹
16
18²
13
14³
15¹
15³
14⁷
24

APPARATUS FOR TRACING ELLIPSES

FIELD OF INVENTION

The present invention relates to apparatus for tracing ellipses or other curves.

The invention is particularly related to the technical field of drafting apparatus.

BRIEF SUMMARY OF THE INVENTION

According to a first feature, this apparatus for tracing ellipses is characterized in that a support in the form of a T made of injection molded material presents a unitary structure judiciously shaped to protect the mechanisms of the apparatus while providing functional support therefor.

According to another feature, the apparatus comprises two shafts perpendicular to one another, parallel to the tracing surface disposed in the same or different plane; the shafts being supported in fixed position in the T-shaped support protecting them; the support having a single longitudinal frontal opening on the surface perpendicular to the tracing surface and a transverse upper opening in the surface parallel to the tracing surface; said openings allow and limit the displacement of sliders essentially constituted by two perpendicular bores independent and judiciously offset; the largest bores being mounted for free movement on the shafts.

DETAILED DESCRIPTION

Figure 4:
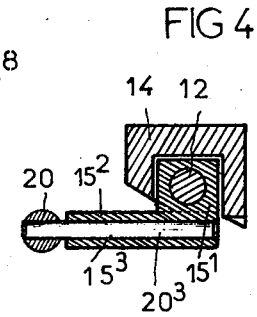
FIG. 4 is a sectional view taken on line IV—IV in FIG. 5 showing the disposition of the slider in the longitudinal branch of the apparatus.
Figure 5:
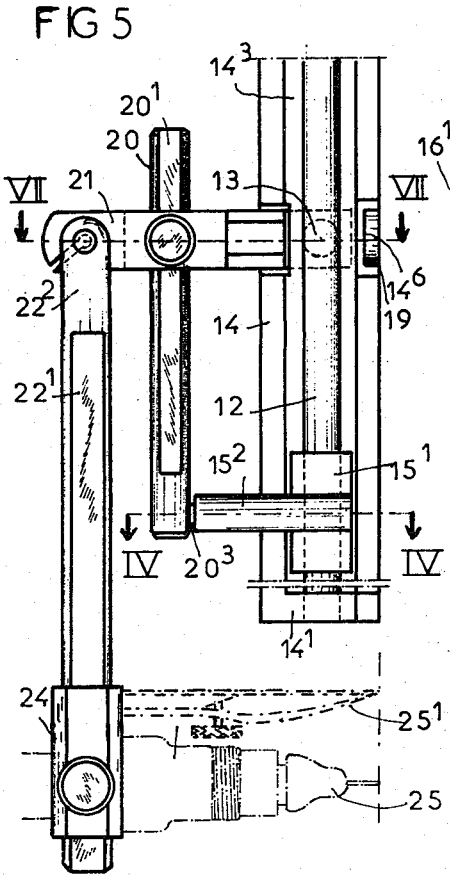
FIG. 5 is a front view of the apparatus provided with tracing units.

The apparatus for tracing ellipses or other curves is designated in entirety by E. It comprises a support F of molded and injected material forming a unitary structure providing protection for the mechanisms of the apparatus while operatively supporting them for carrying out their necessary function. The apparatus also comprises two shafts 12 and 13 perpendicular to one another and parallel to the tracing surface. These are disposed in the same or different planes. The shaft 12 is mounted and supported in demountable relation or not, in known manner, on end walls $14^1$ and $14^2$ of the longitudinal branch 14. The same is formed with an interior recess $14^3$ is formed in longitudinal branch to permit the displacement of the body $15^1$ of slider 15, mounted on the shaft 12 and entirely protected by the upper portion $14^4$ of the longitudinal branch. In particular, it is seen that the upper flange of the longitudinal branch completely covers the shaft 12 from above thereby providing protection therefore. The support F has a single longitudinal frontal opening $14^5$ permitting the passage and external displacement along the branch 14 of a cylindrical support $15^2$, fixed to the body $15^1$ of the slider 15 by any suitable means. The support $15^2$ is disposed perpendicularly to the tracing surface and has an internal bore $15^3$ perpendicular to the bore $15^4$ provided in the shaft 12. This construction is shown in detail in FIG. 4 of the drawings. The internal walls $14^1$ and $14^2$ limit the displacement of the slider 15.

Figure 7:
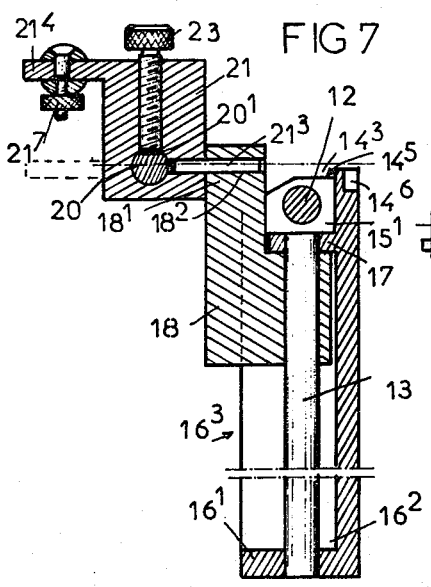
FIG. 7 is a section view taken on line VII—VII in FIG. 5.
Figure 9:
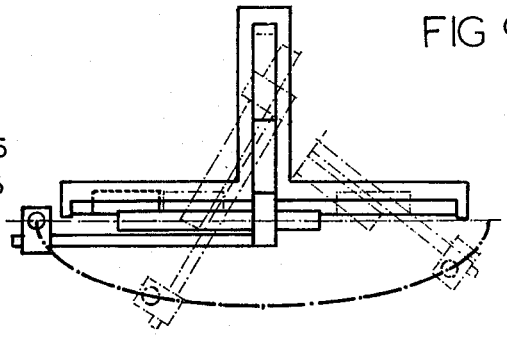
FIG. 9 illustrates the schematic operation of the apparatus.

The transverse shaft 13 is mounted and supported in demountable relation or not between the external wall $16^1$ of the transverse branch 16 and a wall 17 forming an abutment at the intersection of the two branches as clearly shown in FIG. 7 of the drawings. This wall 17 has a smaller height than the level of the upper surface of the support in order to permit the passage of an upper projection $18^1$ of a slider 18 mounted on this transverse shaft 13. Such a position is shown in FIG. 7. The projection $18^1$ is formed with an interior bore $18^2$ perpendicular to a bore $18^3$ provided in the shaft 13 in the same plane. The bore $18^2$ lies in the same plane as the bore $18^3$. Thus, the slider 18 is limited in the course of its travel in the recess $16^2$ on the shaft 13, by the wall 17 and by the exterior wall $16^1$ of the transverse branch. The front projection $18^1$ which extends forwardly towards the longitudinal branch is judiciously shaped in order that when the slider 18 is in abutment against the wall 17, the axis of the interior bore $18^2$ will be aligned with the center line through the bore $15^3$ of the slider 15 as is clearly evident from FIG. 6 of the drawings. The support, therefore, presents with the longitudinal and frontal opening $14^5$ a transverse upper opening $16^3$ parallel to the tracing surface for allowing and limiting the displacement of the upper portions of the sliders mounted for free sliding movement on the shafts.

Figure 6:
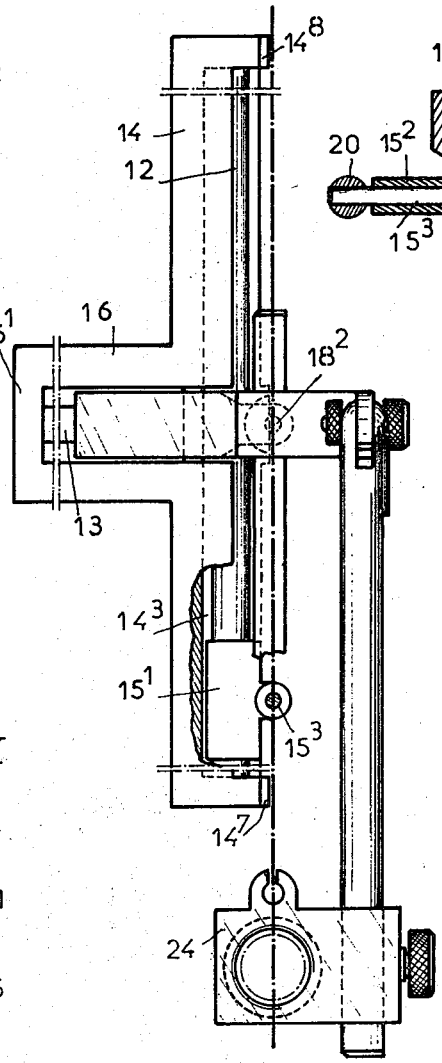
FIG. 6 is a view from above corresponding to FIG. 5.

Another feature of the invention resides in the fact that the support F has at its frontal portion a molded recess $14^6$ in the form of a semi-circle for its support and pivotal movement around a disc 19 of the same diameter having a concentric point which permits it to be point-supported at the intersection of the two axes of the ellipse. In other words, when the point of the disc 19 has been introduced into the tracing surface, the support F will be mounted for free pivotal movement about this center which will lie at the intersection of the two axes of the ellipse. The end walls $14^1$ and $14^2$ of the longitudinal branch 14 have two projections $14^7$ and $17^8$ permitting orientation of the apparatus with respect to the major axes of the ellipse which is visible. This is best seen in FIG. 6 where the major axis of the ellipse is seen to pass through the center of disc 19 and the edges of the projections $14^7$ and $14^8$. It is also to be noted that the axis concurrently passes through the center of the bore $15^3$ of the slider 15.

In significant fashion, the sliders 15 and 8 are guided on shafts 12 and 13 by their horizontal bores $15^4$ and $18^3$ with a minimum play and friction both in translation and in rotation.

Figures 1, 2, 3, 8, 10:
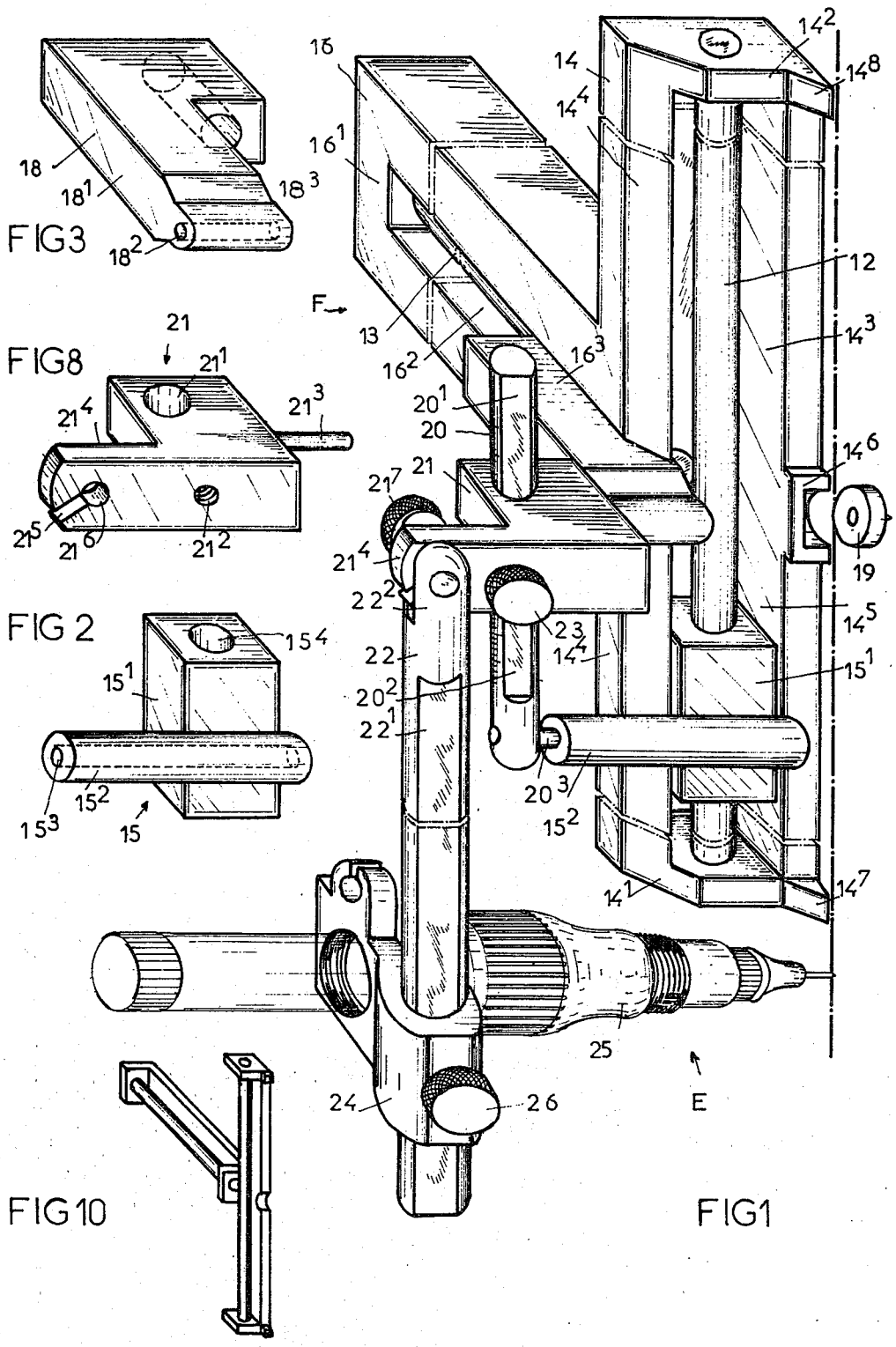
FIG. 1 is a perspective view of the apparatus provided with a tracing unit.
FIG. 2 is a perspective view of a slider mountable on the shaft disposed in the longitudinal branch of the apparatus.
FIG. 3 is a perspective view of the slider mountable on the shaft disposed in the transverse branch of the apparatus.
FIG. 8 is a perspective view of a member freely mounted on a connecting rod and cooperating by its lower shaft slider disposed in the transverse branch and provided with a projection at its upper part to cooperate with the tracing unit.
FIG. 10 is a schematic view of an embodiment of the apparatus.

The two sliders are coupled together by a coupling means which correlates the movements of the sliders and the coupling means comprises a connecting rod 20 having a flat surface $20^1$. The connecting rod additionally comprises a graduation $20^2$ on its upper horizontal surface. At one of the ends of the extremities of the connecting rods, there is a pin $20^3$ extending in a plane through the axis of connecting rod 20, said pin $20^3$ extending perpendicularly to said axis in a downwards direction. The pin $20^3$ forming a guiding finger is introduced into the bore $15^3$ of the slider 15 guided in the longitudinal branch. The connecting rod 20 supports a member 21 of the construction as shown in FIG. 8 of the drawings. The same has an interior bore $21^1$ allowing its displacement on the connecting rod. It can be fixedly secured at any particular precise location thereon by means of a thumb screw 23 mounted in a threaded hole $21^2$ in the adjustable member 21 and bearing against the flat surface $20^1$. At the lower surface of member 21 there is located, suitably centered, a vertical pin $21^3$ which extends both perpendicularly to the bore $21^1$ and to the threaded hole $21^2$ for cooperating with the interior bore $18^2$ of the transverse slider. Finally, the member 21 comprises a projection $21^4$ symmetrical to the plane formed by the axes of the bore $21^1$ and the shaft $21^3$ when the apparatus is utilized with a compass with its piercing point removed, or displaced, parallel to the same plane in the projection of member 21 as shown in FIG. 8 of the drawings for cooperating this time with suitable tracing units. The member 21 can even be provided with two projections simultaneously. This projection mainly described in position has a slot $21^5$ and a bore $21^6$ permitting the passage and articulation on the mounting means $21^7$. The articulation is necessary in order to trace dotted lines by raising the tracing point vertically during the displacement of the apparatus.

The connecting rod 20 is supported in the slides solely by gravity, the two pins $20^3$ and $21^3$ disposed in the bores $15^3$ and $18^2$ being free with a minimum amount of play and friction both in rotation and translation. It is noted that in significant fashion, the system for attachment of the movable member 21 to the connecting rod 20 is so constituted that when the thumb screw 23 is locked on the flat surface of the connecting rod, the two pins $20^3$ and $21^3$ are located in a coaxial plane. Furthermore, the connection of the two sliders by the connecting rod eliminated the possibility of rotation thereof insuring that the axes through the pins $20^3$ and $21^3$ will be constantly and perfectly perpendicular with respect to the tracing surface whatever their position.

One of the tracing units is constituted by a shaft 22 having a flat surface $22^1$. One of the extremities of this shaft forms a cap $22^2$ parallel to the flat surface $22^1$ for cooperating with the upper extremity of the projection $21^4$ of the member 21. A fixation means $21^7$ achieves their connection. A slide member 24 suitably shaped to receive one of the two tracing elements 25 and $25^1$ necessary for tracing small ellipses. The slide member 24 is freely displaceable on the shaft 22 and the attachment of the slide member on the shaft is achieved by thumb screw 26 which can bear against the flat surface $22^1$ of shaft 22. There is thus obtained a perfect perpendicularity of the tracing element with the tracing surface.

From the above, it is seen that the apparatus according to the invention for tracing elliptical curves comprises the T-shaped support member having the perpendicular longitudinal and transverse branches 14 and 16 respectively, said support member being constituted as a one piece molded body and wherein the T-shaped member includes means inclusive of disc 19 and molded recess $14^6$ for providing point support on the tracing surface, means including two sliders 15 and 18 respectively supported in the branches for sliding movement therein, coupling means inclusive of connecting rod 20 coupled to the sliders for correlating movement thereof in the branches and tracer means inclusive of the tracing unit and supports therefore on the coupling means for tracing the curve on the tracing surface in accordance with the movements of the sliders in the recesses of the branches.

The advantages clearly flow from the description, and in particular are underlined:

- perfect quality of the obtained tracing due to precise disposition of the tracing element perpendicularly to the tracing surface,
- construction of the support member of molded and injected material to provide an effective protection for the mechanisms,
- the capability of utilizing conventional tracing units employed in drafting techniques.

The invention is not limited to its modes of application nor to the specific means which have been disclosed; in contrast it covers all variations.

I claim:

1. Apparatus for tracing elliptical curves comprising a T-shaped support member having perpendicular longitudinal and transverse branches and constituted as a one-piece molded body, said T-shaped member including means in said longitudinal branch for providing point support on a tracing surface on which a curve is to be reproduced, means including two sliders respectively supported in the branches for sliding movement therein, coupling means coupled to said sliders for correlating movement thereof in said branches, and tracer means supported by said coupling means for tracing a curve on the surface in accordance with the movement of the sliders, said branches of the T-shaped member having respective recesses and including two support shafts each secured in a fixed position in a respective recess and slidably supporting a respective slider, the recess in one of said branches extending along said one branch at the surface thereof perpendicular to the tracing surface, the recess in the other of the branches extending along said other branch at the upper surface thereof parallel to the tracing surface, said longitudinal and transverse recesses receiving said sliders and permitting travel thereof in said recesses on said support shafts.

2. Apparatus as claimed in claim 1 wherein each slider has two perpendicular bores therein, one of which bores slidably and rotatably receives a respective support shaft.

3. Apparatus as claimed in claim 2 wherein the bores in each slider are of different diameter, the bore of larger diameter receiving the respective shaft.

4. Apparatus as claimed in claim 2 wherein said transverse branch has an end wall, said T-shaped member including an abutment at the intersection of the branches, said shaft in the transverse branch being supported by said end wall and said abutment, said abutment having a height less than the depth of the recess so that the abutment extends upwardly from the bottom of the recess to a level below the upper surface of the transverse branch, the slider in the transverse branch being limited in displacement in the recess by said abutment.

5. Apparatus as claimed in claim 2 wherein said means for providing point support comprises a molded recess in said support member of semi-circular shape for receiving a disc member of a radius equal to that of the molded recess, said disc member having a pointed member positioned at the center thereof coincident with the center of the semi-circular molded recess and adapted for piercing the tracing surface at the center of an ellipse to be drawn to constitute a support on which the apparatus can rotate.

6. Apparatus as claimed in claim 5 wherein said longitudinal branch includes end walls with projections having surfaces aligned with the center of the semi-circular recess to establish the major axis of the ellipse.

7. Apparatus as claimed in claim 6 wherein the slider in the transverse branch has a projection at its upper surface and a bore in said projection positioned such that when the slider abuts against said abutment said bore is in alignment with the center of the ellipse and extends perpendicularly to the tracing plane.

8. Apparatus as claimed in claim 7 wherein said coupling means comprises a connecting rod having a flat surface and graduations on its outer surface adjacent the flat surface, a first pin fixed to said connecting rod and extending perpendicular thereto, said pin being engaged in the other of the bores in the slider in the longitudinal branch, a member slidably mounted on said connecting rod and affixable thereto, a second pin fixed to said member and engaged in the other of the bores in the slider in the transverse branch, said member including projection means releasably engagable with said tracer means, said projection means being disposed with respect to the center of said semi-circular recess to support said tracing means symmetrically with respect thereto.

9. Apparatus as claimed in claim 8 wherein the projection means on said member lies in the same plane as the shaft in the recess in the transverse branch.

10. Apparatus as claimed in claim 9 wherein said connecting rod is supported solely by gravity by the sliders, said pins on the connecting rod and member being respectively freely slidable and rotatably in the sliders.

11. Apparatus as claimed in claim 10 comprising fastener means securing the connecting rod on the member in a fixed position, said pin on the connecting rod extending in a common plane with the pin fixed to said member thereby precluding rotation of the sliders and establishing absolute perpendicularity of the sliders which remains constant with respect to the tracing surface for all positions of displacement.

12. Apparatus as claimed in claim 8 wherein said tracing means comprises a shaft pivotably connected to said projection means on said member, and marking means releasably attachable to the shaft.

13. Apparatus as claimed in claim 12 wherein said tracing means comprises a slide element securable to said shaft in a fixed position thereon, and means on said slide element for releasably receiving a marking instrument.

14. Apparatus as claimed in claim 13 wherein said shaft of the tracing means has a flat surface on which the slide element is positioned and rides, said flat surface extending perpendicular to the tracing surface, and means on said slide element for cooperating with said flat surface on the shaft for securing said slide element to said shaft.

* * * * *